US007906265B2

(12) United States Patent
Suwa et al.

(10) Patent No.: US 7,906,265 B2
(45) Date of Patent: Mar. 15, 2011

(54) FERRITE CARRIER FOR ELECTROPHOTOGRAPHIC DEVELOPER, METHOD FOR PRODUCING THE SAME, AND ELECTROPHOTOGRAPHIC DEVELOPER

(75) Inventors: Tomoyuki Suwa, Kashiwa (JP); Tsuyoshi Itagoshi, Kashiwa (JP)

(73) Assignee: Powdertech Co., Ltd., Kashiwa-Shi, Chiba (JP)

( * ) Notice: Subject to any disclaimer, the term of this patent is extended or adjusted under 35 U.S.C. 154(b) by 981 days.

(21) Appl. No.: 11/729,937

(22) Filed: Mar. 30, 2007

(65) Prior Publication Data

US 2007/0231731 A1 Oct. 4, 2007

(30) Foreign Application Priority Data

Mar. 30, 2006 (JP) ..... 2006-093677

(51) Int. Cl.
*G03G 9/00* (2006.01)

(52) U.S. Cl. ..... 430/111.31; 430/111.32; 430/111.33; 430/111.41

(58) Field of Classification Search ..... 430/111.31, 430/111.32, 111.33, 111.41
See application file for complete search history.

(56) References Cited

U.S. PATENT DOCUMENTS

| | | | | |
|---|---|---|---|---|
| 5,595,850 | A * | 1/1997 | Honjo et al. | 430/111.33 |
| 5,976,747 | A * | 11/1999 | Sato et al. | 430/111.31 |
| 2004/0043320 | A1 * | 3/2004 | Naito et al. | 430/111.33 |
| 2006/0003248 | A1 * | 1/2006 | Kobayashi et al. | 430/111.33 |
| 2006/0014094 | A1 * | 1/2006 | Yuasa et al. | 430/108.2 |
| 2006/0051695 | A1 * | 3/2006 | Yuasa et al. | 430/111.35 |
| 2006/0121385 | A1 * | 6/2006 | Uemura et al. | 430/111.32 |

* cited by examiner

*Primary Examiner* — Mark A Chapman
(74) *Attorney, Agent, or Firm* — Rothwell, Figg, Ernst & Manbeck, P.C.

(57) ABSTRACT

A ferrite carrier for an electrophotographic developer having a compression breaking strength of 150 MPa or more, a rate of compressive change of 15.0% or more and a shape factor SF-1 of 100 to 125, a method for producing the same, and an electrophotographic developer containing the ferrite carrier.

6 Claims, No Drawings

FERRITE CARRIER FOR ELECTROPHOTOGRAPHIC DEVELOPER, METHOD FOR PRODUCING THE SAME, AND ELECTROPHOTOGRAPHIC DEVELOPER

BACKGROUND OF THE INVENTION

1. Field of the Invention

The present invention relates to a ferrite carrier for an electrophotographic developer having a spherical shape, a high compressive strength, a high rate of compressive change, and an excellent strength against breaking due to stress received in a developing box when used for a developer, thereby preventing beads carry over and attaining a longer life, a method for producing the same, and an electrophotographic developer.

2. Description of the Related Art

A two-component electrophotographic developer used in electrophotography is constituted of a toner and a carrier; the carrier is mixed and agitated with the toner in a developing box; the toner is given a desired charge; and the charged toner is carried to an electrostatic latent image on a photoconductor whereby the developer is a carrier material to form a toner image. The carrier is, after having formed the toner image, held by a magnet and stays on a development roller, further returned to the developing box, again mixed and agitated with new toner particles, and repeatedly used in a certain period.

The two-component electrophotographic developer, different from a one-component electrophotographic developer, is one in which the carrier agitates the toner particles, imparts a desired chargeability, and has a function of transporting the toner, has good controllability in developer design, and is therefore widely used in the fields of full-color machines requiring high-quality images and high-speed machines requiring reliability and durability for image maintenance.

In such a two-component electrophotographic developer, ferrite particles made of Cu—Zn ferrite and Ni—Zn ferrite or the like have been used as a carrier in place of an oxide-coated iron powder and a resin-coated iron powder in order to obtain high-quality images. These ferrite carriers using the ferrite particles commonly have a spherical shape, and have many characteristics such as adjustable magnetic properties advantageous over the conventional iron powder carrier in obtaining high-quality images. Furthermore, a resin-coated ferrite carrier coated with any one of various resins using ferrite particles as the carrier core has adjustable specific volume resistance, and has enhanced abrasion resistance and durability or the like.

However, since the ferrite is a kind of ceramics, the ferrite after the ferritization reaction has high hardness. Adversely, the ferrite has the disadvantage that it is crushed by impact. When the particle size is reduced, a space between particles is also reduced, and the fusion of the particles is generated by high-temperature heating to complicate the sustainability of the spherical shape.

In recent years, in such two-component electrophotographic developer, the high-speed and full-color of development performance have been strongly required, and the reduction in the particle size of the carrier and toner has been required in order to obtain high-quality images in the requirement.

Referring to the toner, there have been proposed various toners having a small particle size and a sharp particle size distribution by a polymerized toner art or the like.

On the other hand, a formed magnetic brush is softened by reducing the particle size of the carrier, that is, by using the ferrite particles having a small particle size. Also, the specific surface area of the carrier is increased, and the quantity of the toner capable of being held is increased. As a result, larger effects have been expected for image quality such as image density, fog, toner scattering and tone reproduction.

However, when the particle size of the ferrite carrier is reduced, unfortunately, it becomes more difficult to sustain the spherical shape of the above-described ferrite particles.

Also, when the ferrite carrier with the toner is used as the developer, the ferrite carrier receives strong agitating stress in the developing box, and the carrier particles themselves may be broken. Since the particle size of the broken carrier particles are smaller than a carrier particle size permitted in designing the developer, the carrier particles are developed on the photoconductor with the toner, thereby causing image defects referred to as beads carry over. Since the particle size of the carrier particles has become smaller particularly in recent years, the broken carrier particles are turned into finer particles, which are apt to cause beads carry over.

User requirements for the image quality are increased year by year, and image defects caused by such beads carry over must be reduced as much as possible. Therefore, the carrier particles which are not broken as much as possible even if the carrier particles receives the agitating stress must be designed as one of measures against the beads carry over. As the core material of the carrier, ferrite particles are mainly used now. In the case of the ferrite carrier, according to, for example, Japanese Patent Application Laid-Open No. 9-6052, the breaking strength of the ferrite particles is desirably 5000 $g/cm^2$ or more because such a level of the breaking strength makes the ferrite carrier highly abrasion resistant, and longer even in life.

A sintering step which is a final ferritization reaction step is mentioned as the largest factor for determining the strength of the soft ferrite particles. When the sintering temperature in the sintering step is low, and the growth of particle is not excessively progressed on the contact faces of the primary particles, the particles are apt to be broken to a primary particle size by agitating stress. Therefore, it is necessary to fire the ferrite particles at a temperature of more than a prescribed value in the sintering step in order to enhance the strength of the ferrite particles.

However, the higher the sintering temperature in the sintering step is, the growth of particle of the ferrite particles which are the carrier is progressed, and the strength thereof becomes higher, However, the influence of brittleness which is characteristic of ceramics is increased, and the ferrite particles become a so-called "hard but brittle" state where the ferrite particles are apt to be broken by the agitating stress. Therefore, it is necessary to optimize the sintering temperature in the sintering step, and suppress the influence of the brittleness while maintaining the strength of the ferrite particles themselves to more than a prescribed value in order to enhance the strength of the ferrite particles against the agitating stress in the developing box.

Thus, the ferrite particles (carrier) having strong strength and proper brittle balance, withstanding agitating stress, preventing beads carry over and attaining a longer life have been required.

SUMMARY OF THE INVENTION

Therefore, it is an object of the present invention to provide a ferrite carrier for an electrophotographic developer having a spherical shape, high compressive strength, high rate of compressive change, excellent strength against the breaking due to the stress received in the developing box when used for the developer, and suitable brittleness, thereby preventing beads carry over- and attaining a longer life, a method for producing the same, and an electrophotographic developer.

Then, as a result of keen examinations for solving these problems, the present inventors found that a ferrite carrier using ferrite particles of which a compression breaking strength, a rate of compressive change and a shape factor SF-1 is in a specific range can attain the above object. Also, the present inventors found that such a ferrite carrier can be obtained by limiting a slurry particle size to be a fixed range or lower and by performing calcining and sintering on the limited condition. The present invention was accomplished based on this finding.

That is, the present invention provides a ferrite carrier for an electrophotographic developer having a compression breaking strength of 150 MPa or more, a rate of compressive change of 15.0% or more and a shape factor SF-1 of 100 to 125.

It is desirable that a composition of the above ferrite carrier for an electrophotographic developer according to the present invention is represented by the following general formula:

$$(MnO)_x(MgO)_y(Fe_2O_3)_z,$$

wherein x+y+z=100 mol %, x=35 to 45 mol %, y=5 to 15 mol %, z=45 to 55 mol %, and a part of MnO, MgO and $Fe_2O_3$ is replaced by 0.35 to 5.0 mol % of SrO.

It is desirable that the above ferrite carrier for an electrophotographic developer according to the present invention has an average particle size ($D_{50}$) of 25 to 45 μm.

It is desirable that the above ferrite carrier for an electrophotographic developer according to the present invention is surface-coated with a resin.

Also, the present invention provides a method for producing a ferrite carrier for an electrophotographic developer, comprising the steps of: grinding, mixing and pelletizing ferrite raw materials; calcining the ferrite raw materials at 900 to 1200° C.; grinding the ferrite raw materials calcined; producing slurry using the ferrite raw materials; respectively setting $D_{50}$ and $D_{50}$ of a slurry particle size to 3.0 μm or less and 4.5 μm or less; and spry drying; and performing sintering at 1150 to 1230° C. for 1 to 24 hours.

It is desirable that $D_{50}$ and $D_{90}$ of the slurry particle size are respectively 1.0 to 2.0 μm and 1.5 to 3.0 μm in the above method for producing the ferrite carrier for an electrophotographic developer according to the present invention.

It is desirable that a difference between a temperature for sintering and a temperature for calcining is 250° C. or less in the above method for producing the ferrite carrier for an electrophotographic developer according to the present invention.

It is desirable that a surface is coated with a resin after the sintering in the above method for producing the ferrite carrier for an electrophotographic developer according to the present invention.

Also, the present invention provides an electrophotographic developer comprising the above ferrite carrier and a toner.

The ferrite carrier for an electrophotographic developer according to the present invention has a spherical shape, high compressive strength and high rate of compressive change. Since a developer containing this ferrite carrier for an electrophotographic developer has excellent strength against its breakage due to the stress received in the developing box and has suitable brittleness, beads carry over caused by carrier breakage can be prevented and a longer life can be attained.

According to the producing method according to the present invention, the above-described ferrite carrier for an electrophotographic developer can be economically produced on an industrial scale with a good productivity.

DETAILED DESCRIPTION OF THE PREFERRED EMBODIMENTS

Hereinafter, the embodiments of the present invention will be described.

[Ferrite Carrier for Electrophotographic Developer According to Present Invention]

A ferrite carrier for an electrophotographic developer according to the present invention has a compression breaking strength of 150 MPa or more, and preferably 150 to 300 MPa. Strength of more than a prescribed value against stress received in a developing box is required. When the compression breaking strength is less than 150 MPa, the ferrite carrier is broken by agitating stress in the developing box, and the carrier is apt to be adhered. This compression breaking strength is measured by the following method.

[Compression Breaking Strength]

A Shimadzu micro-compression testing machine "MCT-W500" (manufactured by Shimadzu Corporation) is used, and a plane of ϕ50 μm is used as a kind of an indenter under a testing force of 490 mN, and a load speed of 19.37 mN/sec. The average value of ten tests is made to be compression breaking strength by the following formula.

$$\text{Compression Breaking Strength (MPa)} = 2.8 \times P/(\pi \times d \times d)$$

P: Breaking Test Force (N)

d: Particle Size (mm) of Particle

A ferrite carrier for an electrophotographic developer according to the present invention has a rate of compressive change of 15.0% or more, and preferably 15.0 to 25.0%. The rate of compressive change is used as brittle indicator of the carrier (ferrite particles), and when the rate of compressive change is large, the ferrite particles themselves can absorb instantaneous impact received by the agitating stress in the developing box. When the rate of compressive change is less than 15.0%, the carrier cannot be absorb the above impact, and is apt to be broken. This rate of compressive change is measured by the following method.

[Rate of Compressive Change]

A Shimadzu micro-compression testing machine "MCT-W500" (manufactured by Shimadzu Corporation) is used, and a plane of ϕ50 μm is used as a kind of an indenter under a testing force of 490 mN, and a load speed of 19.37 mN/sec. The average value of ten tests is made to be rate of compressive change by the following formula. The following compression displacement is a distance compressed by the indenter until the particles are broken.

$$\text{Rate of compressive change (\%)} = \Delta d/d \times 100$$

Δd: Compression Displacement (mm)

d: Particle size (mm) of Particle

The ferrite carrier for an electrophotographic developer according to the present invention has a shape factor SF-1 of 100 to 125. Since the closer to a true sphere the shape of the ferrite carrier is, the ferrite carrier has no distortion, the stress due to impact is not unevenly distributed, and the ferrite carrier is hardly broken. When the shape factor SF-1 exceeds 125, the carrier (ferrite particles) is distorted, and the agitating stress in the developing box is concentrated on the portion of the distortion, thereby being apt to be broken. When the ferrite particles themselves have convex portions, the ferrite fine particles are generated by lacking convex portions by the abrasion due to the agitating stress in the developing box. This shape factor SF-1 is used as a factor for expressing a shape of particles or the like, and is based on a statistical method of an image analysis which can analyze quantitatively the area, length and shape or the like of an image caught by a scanning electron microscope or the like in image analysis with a high degree of accuracy, and is measured by the following method.

[Shape Factor SF-1]

The shape factor SF-1 is obtained by using JSM-6060A manufactured by JEOL. Ltd., setting an accelerating voltage to 20 kV, photographing carrier SEM in field of view of 450 times while dispersing particles so that the particles are not overlapped, introducing the image information into an image analyzing soft (Image-Pro PLUS) manufactured by Media Cybernetics, Inc. via interfaces, analyzing the image information to calculate the area (space) and the Feret's size (maximum), and calculating using the following formula. The closer to the sphericity the shape of the carrier is, the closer to 100 the shape factor SF-1 is. The shape factor SF-1 is calculated per one particle, and the average value of 100 particles is defined as the shape factor SF-1 of the carrier.

$$SF\text{-}1=(R^2/S)\times(\pi/4)\times 100$$

R: Feret's Diameter (Maximum), S: Area (Space)

Although the composition of the above ferrite carrier for an electrophotographic developer according to the present invention is not particularly limited, the composition is desirably represented by the following general formula:

$$(MnO)_x(MgO)_y(Fe_2O_3)_z,$$

wherein x+y+z=100 mol %, x=35 to 45 mol %, y=5 to 15 mol %, z=45 to 55 mol %, and a part of MnO, MgO and $Fe_2O_3$ is replaced by 0.35 to 5.0 mol % of SrO.

Since the ferrite particles having such a specific composition have high magnetization and good uniformity of magnetization (low variation of the magnetization), the ferrite particles are desirably used.

It is desirable that the ferrite carrier for an electrophotographic developer according to the present invention has an average particle size ($D_{50}$) of 25 to 45 μm, and more desirably 32 to 38 μm. When the average particle size exceeds 45 μm, the reduction in image quality such as the reduction in image density, fog, toner scattering and tone reproduction is disadvantageously generated. When the average particle size is less than 25 μm, many fine particles already exist in the carrier itself, and the level of beads carry over which should be originally solved is disadvantageously worsened. This average particle size is measured by the following method.

[Average Particle Size (Median Size)]

The average particle size is measured by a laser diffraction scattering method. A Microtrac particle size analyzer (Model 9320-X100) manufactured by Nikkiso Co., Ltd. is used as a device. A refractive index is set to 1.81, and the measurement is performed in an environment of 25±5° C. and 55±15% humidity. Here, the average particle size means an accumulation size particle of 50% in a volume distribution mode and an undersize expression. A carrier sample is dispersed by a supersonic treatment in a ultrasonic homogenizer (UH-3C) manufactured by Ultrasonic Engineering Co., Ltd. for 1 minute using a 0.2% sodium hexametaphosphate solution as a dispersion liquid.

Although the ferrite particles can be used as it is in the ferrite carrier for an electrophotographic developer according to the present invention, the surface of each of the ferrite particles as the carrier core is usually coated with a resin. The resin is desirably coated in an amount of 0.1 to 10% by weight based on the carrier core. With the coating amount of less than 0.1% by weight, the formation of a uniform coating layer on the surface of the carrier core becomes difficult. With that exceeding 10% by weight, the cohesion of the carriers are generated.

The resin used for coating the carrier core is not particularly limited, and various resins can be used as the coating resin. For example, fluororesins, fluoro-acrylic resins, silicone resins and modified silicone resins or the like can be used for a positive charging toner. Conversely, for example, acrylic resins, acrylic-styrene resins, mixed resins and cured resins of the acrylic styrene resin and melamine resin, silicone resins, modified silicone resins, polyester resins, epoxy resins, urethane resins and polyethylene resins or the like can be used for a negative charging toner.

A charge control agent, an adhesion enhancer, a priming agent or a resistance control agent may be optionally added. Examples of the charge control agents and resistance control agents include various silane coupling agents, various titanium coupling agents, conductive carbon, borides such as titanium boride, and oxides such as titanium oxide and iron oxide, an aluminum oxide, a chromic oxide and a silicon oxide. However, the charge control agents and the resistance control agents are not particularly limited thereto.

[Method for Producing Ferrite Carrier for Electrophotographic Developer According to Present Invention]

Next, a method for producing a ferrite carrier for an electrophotographic developer according to the present invention will be described. First, after weighing an adequate quantity of ferrite raw materials so as to be a specified composition, it is ground and mixed in a ball mill or a vibration mill or the like for 0.5 hour or more, desirably 1 to 20 hours. After palletizing thus obtained ground material using a compression molding machine or the like, the pellets are preliminarily fired at a temperature of 900 to 1200° C. for 1 to 24 hours in a rotary firing furnace, a burner firing furnace or an electric furnace or the like. When the calcining temperature is less than 900° C., a space in the carrier after the sintering is disadvantageously apt to take place to cause inferior strength. When the calcining temperature exceeds 1200° C., the calcined material is hardly ground in the next step. Instead of using the compression molding machine, the ferrite raw material can be granulated after grinding, producing slurry by adding water, and spray-drying the slurry. When grinding after calcining, the material can be ground using a wet ball mill or a wet vibration mill or the like after adding water.

After calcining, the ferrite raw material is further ground using a ball mill or a vibrating mill or the like, water and, as required, an adequate quantity of a dispersant and a binder and the like are added to produce a slurry. After respectively setting $D_{50}$ and $D_{90}$ of the slurry particle size to 3.0 μm or less and 4.5 μm or less, and adjusting viscosity, the material is then granulated using a spray dryer. After the granulated material is held at a temperature of 500 to 700° C. for 1 to 24 hours in a burner firing furnace, a rotary firing furnace or an electric furnace or the like, and additives such as a binder are removed, the sintering is performed at a temperature of 1150 to 1230° C. for 1 to 24 hours in the burner firing furnace, the rotary firing furnace or the electric furnace or the like. When the sintering temperature is less than 1150° C., growth of particle is not excessively progressed on the contact faces of primary particles, and the particles are disadvantageously apt to be broken to a primary particle size by the agitating stress. When the sintering temperature exceeds 1230° C., the strength is increased according to the progression of the growth of particle. However, the influence of brittleness which is the characteristic of ceramics is increased, and the particles are disadvantageously apt to be broken by the agitating stress. In the sintering, the saturation magnetization and the electric resistance can be adjusted by controlling the oxygen concentration.

In the producing method according to the present invention, as described above, D50 of the slurry particle size is 3.0 μm or less, and desirably 1.0 to 2.0 μm. When the above $D_{50}$ exceeds 3.0 μm, it is disadvantage that the gaps are apt to be formed in the carrier after the sintering and the strength is inferior as in the case where the calcining temperature is less than 900° C. The above $D_{50}$ of less than 1.0 μm causes the excessive increase in slurry viscosity, and the shape of the granulated material obtained by the spray drier is disadvantageously worsened. It is necessary to reduce the $D_{90}$ showing the content of coarse particles in the slurry in the producing method according to the present invention, and the $D_{90}$ of the slurry particle size is preferably 4.5 μm or less, and particularly preferably 1.5 to 3.0 μm. When the above $D_{90}$ exceeds 4.5 μm, the shape of the carrier surface after the sintering is disadvantageously formed in a protrusion and recess shape. Furthermore, it is disadvantageous that the gaps are apt to be formed in the carrier after the sintering and the strength is inferior as in the case where the calcining temperature is less than 900° C. and the case where $D_{50}$ exceeds 3.0 μm. The slurry particle size is measured using a Microtrac Particle Size Analyzer (Model 9320-X100) manufactured by Nikkiso Co., Ltd. The detail is as follows. Here, $D_{50}$ means an accumulation size particle of 50% in a volume distribution mode and an undersize expression, and $D_{90}$ means an accumulation size particle of 90% in a volume distribution mode and an undersize expression. The environment, refractive index and dispersion method in measuring the slurry particle size are performed on the same condition as that of the measurement of the above carrier average particle size.

In order to make slurry particle sizes as described above, it can be achieved by grinding the material using the above-described grinding machine such as the ball mill and the vibration mill for an adequate time. When media are used in such a grinding step, various media or beads can be used. They are different depending on grinding machines, the hardness, particle size, and target particle size after grinding of the material to be ground, and are suitably selected. The above-described slurry particle sizes can be also achieved by grinding the material with a wet ball mill or the like and grinding it again with a pulverizer having a high-speed shear stress.

Although such a pulverizer is not specifically limited, for example, a high-speed rotary grinding machine, an agitating-tank-type media agitating grinding machine, a distribution-pipe-type media agitating grinding machine, or the like are included. As the media used in the agitating grinding machine, the above-described various media or beads can be used. Although they are different depending on grinding machines, the hardness, particle size, and target particle size after grinding of the material to be ground, the use of beads having a small particle size is preferable, and the use of beads having a particle size of 0.3 to 1 mm is more preferable.

The difference between the sintering temperature and the calcining temperature is desirably 250° C. or less in the method for producing according to the present invention, and more desirably 190° C. or less. When the above temperature difference exceeds 250° C., the carrier having the above-described quality and characteristics is hardly obtained. Since the difference between the thermal expansion and contraction of the particles in the calcining step and the sintering step is particularly large, it is believed that the gaps are apt to be formed in the carrier.

The sinter obtained in such a manner is crushed and classified. The classifying method involves adjusting the particle size to a desired one by using the existing air classification, screening and precipitation method or the like to obtain a carrier (ferrite particles).

Thereafter, the classified particles may optionally be oxide coating by heating their surfaces in a low temperature to adjust electric resistance. The oxide coating requires a common type of electric furnace such as a rotary electric furnace and a batch-type electric furnace, and the heat treatment is conducted at a temperature of 300 to 700° C., for example. The thickness of the oxide coating formed by this treatment is desirably 0.1 nm to 5 μm. If the thickness is less than 0.1 nm, the effect of the oxide coating layer is low. If that exceeds 5 μm, since the magnetization decreases, and the electric resistance becomes too high, disadvantages such as the decrease in developing capacity are apt to take place. The reduction may be optionally conducted prior to oxide coating.

Although the ferrite particles obtained thus is used as the ferrite carrier for an electrophotographic developer according to the present invention, as described above, the ferrite particles are used as the carrier core, and the surface of each of the ferrite particles is usually coated with a resin. As a method for coating the resin, the resin is usually diluted in a solvent, and the resultant solution is coated on the surface of the above carrier core. The amount of and kind of the resin coated are as described above. Examples of solvents used here include toluene, xylene, cellosolvebutylacetate, methylethylketone, methylisobutylketone and methanol when the resin is soluble in an organic solvent. Water may be used when the resin is a water-soluble resin or an emulsion resin. As methods for coating the above-described carrier core with the above-described coating resin, methods known to the art, for example, brushing method, a dry method, spray drying method using a fluidizing bed, rotary drying method, immersion and drying method using a universal agitator or the like can be used. In order to improve the coating rate, the method using a fluidizing bed is preferable.

When baking is performed after coating the carrier core with a resin, either an externally heating system or an internally heating system can be used, and for example, a stationary or fluidizing electric furnace, a rotary electric furnace, a burner furnace can be used, or microwave baking can be also used. Although the baking temperature differs depending on the resin to be used, the temperature of the melting point or the glass transition temperature or above is required, and in thermosetting resins or condensation cross-linking resins, the temperature must be raised until the resin cures completely.

Thus, after the resin is covered and baked on the surface of the carrier core, the carrier core is cooled and ground, and the particle size is adjusted to obtain the ferrite carrier for an electrophotographic developer according to the present invention.

[Electrophotographic Developer According to Present Invention]

The ferrite carrier for an electrophotographic developer according to the present invention obtained as described above is mixed with a toner, and is used as a two-component developer.

The toner used for the present invention can be produced by known methods such as a suspension polymerization method, an emulsion polymerization and a grinding method. As the example of the preparing method, the toner having a desired particle size can be obtained by sufficiently mixing a binding resin, a colorant and a charge control agent or the like using a mixer such as a Henschel mixer, then melting and kneaded using a twin-screw extruder or the like to uniformly disperse the mixture, cooling, finely grinding using a jet mill or the like, and classifying the mixture using a wind-power classification machine or the like. Wax, magnetic powder, viscosity adjusters and the other additives may be optionally included. External additives or the like can be also added after classifying.

Although the binding resin used for the above-described toner is not particularly limited, polystyrene, chloropolystyrene, styrene-chlorostyrene copolymers, styrene-acrylic ester copolymers, styrene-methacrylic acid copolymers, further, rosin-modified maleic acid resins, epoxy resins, polyester resins, polyethylene resins, polypropylene resins, polyurethane resins and silicone resins or the like can be optionally used alone or in combination.

Examples of the charge control agents capable of being used for the above-described toner include a nigrosin dye, a quaternary ammonium salt, an organic metal complex, a chelate complex and a metal-containing monoazo dye.

As coloring agents used for the above-described toner, conventionally-known dyes and/or pigments can be used. For example, carbon black, phthalocyanine blue, permanent red, chrome yellow, phthalocyanine green or the like can be used.

In addition, as the external additive, silica, titanium oxide, barium titanate, alumina, a metal salt of stearic acid, fine fluorine resin particles, fine acrylic resin particles or the like can be used alone, or in combination.

The present invention will be specifically described below on the basis of examples or the like.

Example 1

MnO, MgO, $Fe_2O_3$ and $SrCO_3$ were weighed so as to have the composition of MnO: 39.7 mol %, MgO: 9.9 mol %, $Fe_2O_3$: 49.6 mol % and $SrCO_3$: 0.8 mol %. After this mixture was ground using a wet ball mill for 1 hour, mixed and dried, calcining was performed while the mixture was held at 1000° C. for 3 hours using an electric furnace. This was ground using a wet ball mill for 6 hours, and was then ground using a wet bead mill for 10 hours to respectively set the average particle sizes $D_{50}$ and $D_{90}$ of the slurry to 1.4 μm and 1.8 μm.

Adequate quantities of a dispersant and binder were added to this slurry, then granulated and dried using a spray dryer and held in an electric furnace of a temperature of 650° C. for 3 hours to remove additives such as the binder or the like. The granulated material after removing the additives was held in the electric furnace of a temperature of 1180° C. and an oxygen concentration of 0.7 vol. % for 4 hours to perform sintering. After the obtained sinter was crushed, classifying was performed, and ferrite particles (carrier core) were obtained.

The compression breaking strength, rate of compressive change, shape factor SF-1 and average particle size of the carrier core thus obtained were measured by the above-described method. The results are shown in Table 1.

A silicone resin (trade name: SR-2411, solid content: 20% by weight, manufactured by Dow Corning Toray Co., Ltd.) was dissolved in toluene, and 1.0% by weight as solid of the resin against the ferrite core was coated on the carrier core using immersing in the solution and drying and baked at 250° C. for 3 hours, and then the ferrite carrier coated with the above resin was obtained.

A developer was prepared using the ferrite carrier obtained as described above and a toner. As the toner, a magenta toner (T-FC22-M) manufactured by Toshiba TEC Corp. was used, and the toner concentration was set to 7.0% by weight. The ferrite carrier and the toner were agitated for 60 minutes using a ball mill. This developer was evaluated in a full color digital multi function printer "FANTASIA 22i" manufactured by Toshiba TEC Corp. as an actual machine, and beads carry over and image density of the developer at the first stage and after 50K sheets of continuous printing were evaluated. To evaluate beads carry over, a full solid was printed on five A3 sheets, and the tactile sense evaluation by stroking the printed surface by hands and the level of white spot on the sheets were performed. To evaluate image density, a full solid was similarly printed on five A3 sheets, and the image density was measured and evaluated at five places, that is, four corners and a center using a reflection densitometer (Macbeth densimeter RD-914). These results are shown in Table 1. Here, each of valuation standards in Table 1 is shown below.

[Valuation Standard]

○: Good Level

Δ: Practicable Level

X: Unpracticable Level

Example 2

As shown in Table 1, a carrier core was obtained in the same manner as in Example 1 except that the mixture was ground using the wet ball mill for 6 hours, then ground using the wet bead mill for 6 hours to set the average particle sizes $D_{50}$ and $D_{90}$ of the slurry to 1.6 μm and 2.4 μm, and the sintering temperature was set to 1150° C. The compression breaking strength, rate of compressive change, shape factor SF-1 and average particle size of this carrier core are similarly estimated in the same manner as in Example 1. The results are shown in Table 1.

Furthermore, a ferrite carrier for an electrophotographic developer and a developer were prepared in the same manner as in Example 1 using this carrier core. Beads carry over of the developer was evaluated in the same manner as in Example 1. The results are shown in Table 1.

Comparative Example 1

As shown in Table 1, a carrier core was obtained in the same manner as in Example 2 except that granulating condition due to the spray drier was changed; the sintering temperature was set to 1270° C.; and the classifying condition after the sintering was changed. The compression breaking strength, rate of compressive change, shape factor SF-1 and average particle size of this carrier core are similarly estimated in the same manner as in Example 1. The results are shown in Table 1.

Furthermore, a ferrite carrier for an electrophotographic developer and a developer were prepared in the same manner as in Example 1 using this carrier core. Beads carry over of the developer was evaluated in the same manner as in Example 1. The results are shown in Table 1.

Comparative Example 2

As shown in Table 1, a carrier core was obtained in the same manner as in Example 1 except that the calcining temperature was set to 800° C.; the mixture was ground using the wet ball mill for 8 hours; the slurry average particle sizes $D_{50}$ and $D_{90}$ were respectively set to 3.2 μm and 4.4 μm; the granulating condition due to the spray drier was changed; the sintering temperature was set to 1250° C.; and the classifying condition after the sintering was changed. The compression breaking strength, rate of compressive change, shape factor SF-1 and average particle size of this carrier core are similarly estimated in the same manner as in Example 1. The results are shown in Table 1.

Furthermore, a ferrite carrier for an electrophotographic developer and a developer were prepared in the same manner as in Example 1 using this carrier core. Beads carry over of the developer was evaluated in the same manner as in Example 1. The results are shown in Table 1.

Comparative Example 3

As shown in Table 1, a carrier core was obtained in the same manner as in Example 1 except that the calcining temperature was set to 750° C., the mixture was ground using the wet ball mill for 6 hours; the average particle sizes $D_{50}$ and $D_{90}$ of the slurry were respectively set to 3.9 μm and 5.9 μm; the sintering temperature was set to 1100° C.; and the oxygen concentration was set to 0.0 vol. %. The compression breaking strength, rate of compressive change, shape factor SF-1 and average particle size of this carrier core are similarly estimated in the same manner as in Example 1. The results are shown in Table 1.

Furthermore, a ferrite carrier for an electrophotographic developer and a developer were prepared in the same manner as in Example 1 using this carrier core. Beads carry over of the developer was estimated in the same manner as in Example 1. The results are shown in Table 1.

As clarified from the results in Table 1, the carrier cores (ferrite particles) used in Examples 1 to 2 have high spherical degree, high compressive strength and high rate of compressive change. On the other hand, the carrier core of Comparative Example 1 has low rate of compressive change, and the carrier cores of Comparative Examples 2, 3 have inferior spherical degree. Furthermore, the carrier core of Comparative Example 3 has low compression breaking strength.

Also, as clarified from the actual machine test of Table 1, the carrier cores of Examples 1 and 2 have remarkably lower beads carry over after 50K sheets of continuous printing than those of Comparative Examples 1 to 3. Particularly, in Comparative Example 2, the beads carry over is much from the first stage.

As clarified from these results, high compressive strength, high rate of compressive change and high spherical rate are required for the carrier core (ferrite particles) in order to prevent the beads carry over.

The ferrite carrier for an electrophotographic developer according to the present invention has a spherical shape and high compressive strength and high rate of compressive

TABLE 1

| | Example 1 | Example 2 | Comparative Example 1 | Comparative Example 2 | Comparative Example 3 |
|---|---|---|---|---|---|
| Slurry particle size $D_{50}$ (μm) | 1.4 | 1.6 | 1.6 | 3.2 | 3.9 |
| Slurry particle size $D_{90}$ (μm) | 1.8 | 2.4 | 2.4 | 4.4 | 5.9 |
| Calcining temperature (° C.) | 1000 | 1000 | 1000 | 800 | 750 |
| Sintering temperature (° C.) | 1180 | 1150 | 1270 | 1250 | 1100 |
| Temperature difference between the sinterings (° C.) | 180 | 150 | 270 | 450 | 350 |
| Compression breaking strength (MPa) | 256.8 | 172.2 | 185.2 | 190.6 | 74.2 |
| Rate of compressive change (%) | 17.0 | 17.5 | 5.9 | 17.1 | 14.4 |
| SF-1 (Feret's size) | 110 | 108 | 112 | 132 | 127 |
| Average particle size $D_{50}$ (μm) | 35.1 | 34.2 | 50.7 | 22.4 | 34.0 |
| Evaluation results of the developer in actual machine First stage | | | | | |
| Solid beads carry over | ○ | ○ | ○ | X | Δ |
| Image density | ○ | ○ | Δ | ○ | ○ |
| After 50K sheets of continuous printing | | | | | |
| Solid beads carry over | ○ | ○ | X | X | X |
| Image density | ○ | ○ | Δ | ○ | ○ |

change. Since the developer containing this ferrite carrier has excellent strength against the breaking due to the stress received in the developing box and has suitable brittleness, the beads carry over caused by carrier breakage can be prevented and a longer life can be attained.

According to the producing method according to the present invention, the above-described ferrite carrier for the electrophotographic developer can be economically produced at industrial-scale productivity.

Therefore, the present invention can be suitably used for the two-component electrophotographic developer used in the electrophotography.

What is claimed is:

1. A ferrite carrier for an electrophotographic developer having a compression breaking strength of 150 MPa or more, a rate of compressive change of 15.0% or more and a shape factor SF-1 of 100 to 125, and wherein the ferrite carrier is produced according to a method comprising the steps of:

grinding, mixing and pelletizing ferrite raw materials;

calcining the pellets at 900 to 1200° C.;

grinding the preliminarily fired pellets;

producing a slurry from the resulting particles;

setting slurry particle sizes $D_{50}$ and $D_{90}$ at 3.0 μm or less and 4.5 μm or less respectively; and sintering at 1150 to 1230° C. for 1 to 24 hours.

2. The ferrite carrier for an electrophotographic developer according to claim 1, wherein the carrier has a composition represented by the following general formula:

$$(MnO)_x(MgO)_y(Fe_2O_3)_z$$

wherein x+y+z=100 mol %, x=35 to 45 mol %, y=5 to 15 mol %, z=45 to 55 mol %, and a part of MnO, MgO and $Fe_2O_3$ is replaced by 0.35 to 5.0 mol % of SrO.

3. The ferrite carrier for an electrophotographic developer according to claim 1, wherein the ferrite carrier has an average particle size ($D_{50}$) of 25 to 45 μm.

4. The ferrite carrier for an electrophotographic developer according to claim 1, wherein the ferrite carrier is surface-coated with a resin.

5. An electrophotographic developer comprising the ferrite carrier according to claim 1 and a toner.

6. A ferrite carrier for an electrophotographic developer having a compression breaking strength of 150 MPa or more, a rate of compressive change of 15.0% or more and a shape factor SF-1 of 100 to 125.

* * * * *